US008887905B2

(12) United States Patent
Muhlemann

(10) Patent No.: US 8,887,905 B2
(45) Date of Patent: Nov. 18, 2014

(54) PLASTIC CLOSURE HAVING A CAPSULE FOR DISPENSING ACTIVE INGREDIENTS

(75) Inventor: Rolf Muhlemann, Schlattingen (CH)

(73) Assignee: Muhlemann IP GmbH, Stein am Rhein (CH)

( * ) Notice: Subject to any disclaimer, the term of this patent is extended or adjusted under 35 U.S.C. 154(b) by 7 days.

(21) Appl. No.: 13/879,000

(22) PCT Filed: Jul. 11, 2011

(86) PCT No.: PCT/EP2011/062826

§ 371 (c)(1),
(2), (4) Date: Apr. 11, 2013

(87) PCT Pub. No.: WO2012/048922

PCT Pub. Date: Apr. 19, 2012

(65) Prior Publication Data

US 2013/0193010 A1 Aug. 1, 2013

(30) Foreign Application Priority Data

Oct. 13, 2010 (CH) ..... 1670/10

(51) Int. Cl.
*B65D 25/08* (2006.01)
*B65D 51/28* (2006.01)

(52) U.S. Cl.
CPC ..... *B65D 51/28* (2013.01); *B65D 51/2835* (2013.01); *B65D 51/2807* (2013.01); *B65D 25/08* (2013.01)
USPC ..... 206/222; 206/219; 206/220; 206/221

(58) Field of Classification Search
CPC ..... B65D 51/2835; B65D 51/2864; B65D 51/2807; B65D 25/08; A61J 1/2093
USPC ..... 206/219, 220, 221, 222; 215/DIG. 8
See application file for complete search history.

(56) References Cited

U.S. PATENT DOCUMENTS

| | | | | | |
|---|---|---|---|---|---|
| 4,247,001 | A * | 1/1981 | Wiegner | 206/222 |
| 4,610,374 | A * | 9/1986 | Buehler | 222/83 |
| 5,042,690 | A * | 8/1991 | O'Meara | 222/83 |
| 5,255,812 | A * | 10/1993 | Hsu | 220/277 |
| 5,685,422 | A * | 11/1997 | Kim | 206/222 |
| 5,938,363 | A * | 8/1999 | Timms et al. | 401/209 |
| 6,003,728 | A * | 12/1999 | Elliott | 222/81 |
| 6,997,917 | B2 * | 2/2006 | Niedospial et al. | 604/411 |
| 7,584,842 | B2 * | 9/2009 | Neumeyer et al. | 206/222 |
| 7,607,549 | B2 * | 10/2009 | Morini | 215/297 |
| 7,806,258 | B2 * | 10/2010 | Smith et al. | 206/221 |
| 7,971,739 | B2 * | 7/2011 | Ammann | 215/257 |
| 2006/0249473 | A1 | 11/2006 | Kunz | |

* cited by examiner

*Primary Examiner* — Andrew Perreault
*Assistant Examiner* — James M Van Buskirk
(74) *Attorney, Agent, or Firm* — Janet Sleath; Speckman Law Group PLLC

(57) ABSTRACT

In a plastic closure (1), preferably configured as a screw cap, a capsule having a chamber (3) is formed with a capsule wall (2), wherein said capsule is closed both by means of a flexible membrane (6) and by means of a film (4) which seals the chamber (3). An active ingredient B to be dispensed is accommodated in the chamber (3). The sealing film (4) can be destroyed or pushed away by means of a piercing member (7). The piercing member (7) is configured to be replaceable. As a result the plastic closure (1) itself can be produced as standard, and the piercing member (7) can be produced customer-specifically for the respective application. The connection between the piercing member (7) and the convex membrane (6) preferably takes place by means of a coupling part (8) which is formed on the lower face of the convex membrane and on which the piercing member (7) having a cup-shaped coupling attachment receptacle (74) can be fitted.

5 Claims, 2 Drawing Sheets

PLASTIC CLOSURE HAVING A CAPSULE FOR DISPENSING ACTIVE INGREDIENTS

This application is the U.S. national phase entry of International Patent Application no. PCT/EP2011/062826, filed Jul. 26, 2011, which claims priority to Swiss patent application no. 01670/10 filed Oct. 13, 2010.

TECHNICAL FIELD OF THE INVENTION

The present invention relates to a plastic closure having an integrated capsule for dispensing solid, granulated or liquid active ingredients, comprising a cylindrical or conical capsule wall with a chamber at its lower end, the chamber being sealable by means of a film, wherein in the area of the upper end of the capsule wall a convex, flexible membrane is formed onto the same in one piece therewith, by means of which a piercing member can be operated, wherein the plastic closure part comprises a shell wall with fastening means which are connected with the capsule wall via a ring-shaped covering surface and wherein the shell wall concentrically encircles the capsule wall and in that the piercing member prior to the operation of the convex membrane rests completely inside the chamber.

BACKGROUND

Increasingly, capsules are offered on the market which contain active ingredients for the preparation of beverages. These active ingredients may be present in a solid, liquid or granulated form. Capsules of this kind comprise capsules which are suitable for the preparation of coffee. Typical examples of such capsules are shown in EP-A-0 512 468 and EP-A-1 190 959.

Substantially more complex are closures in various shapes or forms which comprise a storage space serving as a capsule and from which a solid, liquid or granulated active ingredient is to be dispensed into a container, on which the closure is fastened. One of the oldest closures of this kind is disclosed, for example, in document GB-A-1193989. Here a plug-on collar is placed on top of a container neck, which comprises an upwardly extending, cylindrical wall, wherein this wall is formed as a closed cylinder, in which a hollow press piston is mounted, which is filled with the respective active ingredient. A separate protective cap is placed on top of the piston cylinder part. A closure of this kind comprises many individual components, and it is not possible to fit and use it on conventional filling machines.

A very similar system is known from WO-A-03093128. Both in the case of this closure with integrated chamber and in case of the previously described closure, once the active ingredient has been dispensed, the capsule consisting of piston and cylinder unit must be removed.

A somewhat different system is disclosed in U.S. Pat. No. 6,886,686. Again a separate chamber exists in which a ram is mounted which must be pressed downwards. The cylinder of the capsule is provided with a piercable bottom, to which the ram is attached. Here too, the capsule comprises a moving part configured as a flying piston which acts upon the ram, and this in turn pivots the bottom partly to one side.

More and more foodstuffs, medicines, cosmetics, adhesives and cleaning agents, as well as other substances described altogether as active ingredients, are offered in highly concentrated form. This has the advantage of reducing package sizes, lowering of transport costs and thereby reducing packaging expenditure. The disadvantage is that all these active ingredients in a highly concentrated form must be subsequently dosed to obtain the required usage quantities and then be added in a dosed manner to a liquid, i.e. a solvent in the widest sense. Frequently consumers do not take sufficient notice of the advice regarding the dosed quantity and tend to dispense a much higher concentration than required. This is detrimental to the end product to be produced and consumers will notice that the goods bought in concentrated form, in the end, cost more than if they had bought them in their ready-to-use diluted form. This has lead to the fact that the concentrated form of such active ingredients has not come to be accepted to the extent that would be desirable.

Therefore there has been a move towards offering these concentrated active ingredients in pre-dosed quantities. In the case of active ingredients in powder form these are offered in the form of tablets, capsules or lozenges. However, not all powdery active ingredients are suitable for being dispensed as tablets. And even if these active ingredients are dispensed in predefined portions, the corresponding liquid portions are missing which, usually after having been dosed, must then again be mixed with the solid or granulated active ingredients.

A capsule according to the preamble of patent claim 1 has been disclosed in document WO 2010/084176. In this instance the capsule is combined with the screw closure, and has a cylindrical capsule wall which is closed at its lower end by means of a destructible film, and the upper end of which has a convex flexible membrane to which a piercing member is attached, which prior to operating the convex membrane is completely contained in the chamber, and following operation of the membrane partially protrudes from the chamber, piercing the film. As already mentioned these combined capsule closures are used to dispense both solid and granulated or liquid active ingredients. Often these different types of active ingredient also mean that they cannot simply be stored in the capsule but must be stored specially, in particular in blister packs, in order to achieve an improved gas seal or liquid seal. As such it would be perfectly feasible to store a blister pack inside the capsule, or the blister pack itself could form a destructible film. This means that depending on the type of active ingredient a completely different type of destructible film could exist, i.e. not merely an aluminium film, but instead also a plastic film, a blister pack etc. These different possibilities of devising capsule closures also mean that different piercing members are required, i.e. piercing members which merely cause a perforation, or which cause a cut or which merely pierce. In practice this means that, depending on the ingredient stored in the capsule, a completely new injection mould must be employed. If a company then intends to offer an assortment of such closures, this would mean extremely high investments.

SUMMARY

It is the requirement of the present invention to modify a plastic closure with capsule of the kind discussed above in such a way that for small modifications and a small investment volume a whole series of such capsule closure can be manufactured which are suitable for a wide variety of films sealing the capsule. This requirement is met by a plastic closure with integrated capsule of the kind discussed above, which capsule is characterised in that the lower face of the convex membrane can be brought into operative contact with a replaceable piercing member.

Further advantageous designs of the capsule are described below.

BRIEF DESCRIPTION OF THE DRAWINGS

Various embodiments of the subject according to the invention are depicted in the drawing and explained in the description below. In the drawings

DETAILED DESCRIPTION

Figure 2:
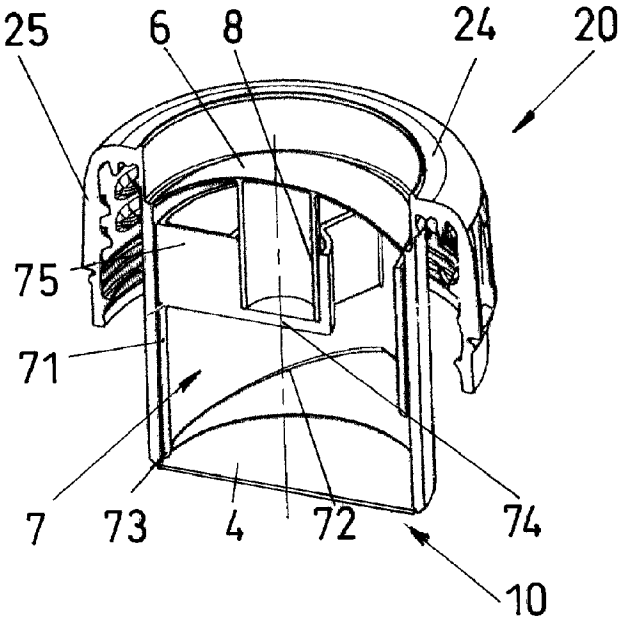
FIG. 2 shows a perspective view of the same plastic closure, again in diametrical section but with piercing member, and the destructible film.

The plastic closure with capsule is marked overall with reference symbol 1. This consists of a capsule part 10 and a screw closure part 20. The capsule part 10 and the screw closure part 20 are formed integrally in one piece. The capsule part 10 comprises a capsule wall 2. This capsule wall 2 is preferably, but not necessarily, formed cylindrically. Preferably at least the outside of the capsule wall would be provided with a slightly conical taper in order to achieve improved demoulding. As such the outside of the capsule wall 2 will have a slightly larger diameter in the open area than in the closed area.

This capsule wall 2 is closed in the upper area 5 by a flexible convex membrane 6 which is formed integrally on the inside of the capsule wall 2. This causes a chamber 3 to be formed below the flexible, convex membrane 6. When viewing the capsule part 10 from the open lower face a kind of cup is formed, the bottom of which, in this case, is the flexible, convex capsule membrane 6. This kind of cup can be filled in conventional filling plants without problems with any given active ingredient W. This active ingredient may be filled into the chamber 3 in a liquid, solid (for example as several tablets), flowing or granulated form. Subsequently, in conventional filling plants, the chamber 3 may be sealed by means of a destructible film 4.

The destructible film 4 may be configured as a plastic film or an aluminium film or even as a dense paper film or a blister. Again in conventional filling plants, the film can be welded on or glued on. In case of a blister the plastic film would be welded to the rim of the capsule wall, and the piercing member presses against the convex part of the blister.

The integrally formed capsule wall 2 with the flexible convex membrane 6 may be produced in one piece by the injection-moulding technique. For particular active ingredients, the entire part or at least the capsule wall 2 with the flexible convex membrane 6 may be produced directly with a barrier layer, by injection-moulding.

The embodiment depicted in the figures shows a capsule 1 which is formed integrally to form a screw cap closure 1. The shell wall 25 of the closure comprises an internal thread 21. It concentrically encircles a horizontal ring-shaped covering surface 24 and then merges directly with the capsule wall 2, which forms the chamber 2. Inside the capsule wall 2 exists the convex membrane 6, on the lower face of which a coupling attachment 8 is formed. The capsule wall 25 has a guarantee band 27 formed onto it here via predetermined breaking point bridges 26.

Figure 1:
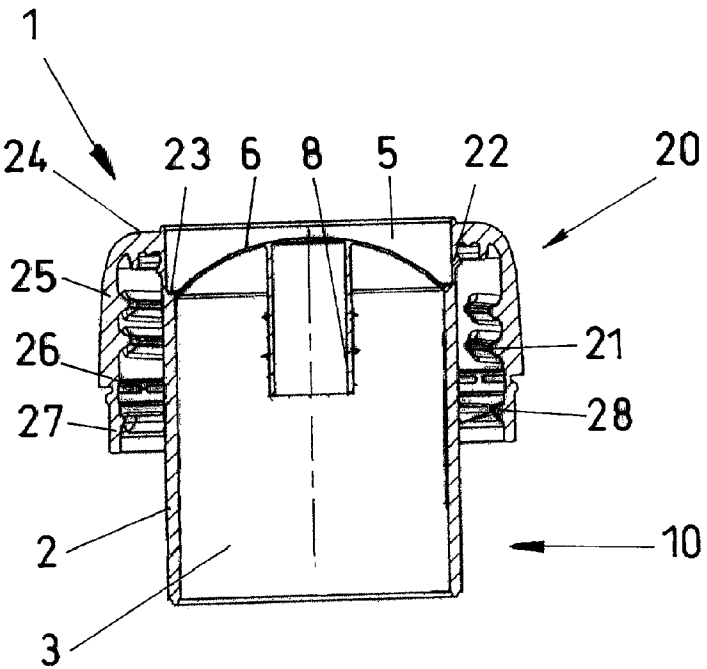
FIG. 1 shows a plastic closure according to the invention as a screw closure without piercing member, in diametrical longitudinal section.

Joined onto the ring-shaped covering surface 24 is an inner relatively thin annular wall 22, which merges with the capsule wall 2 via a shoulder 23. The convex membrane 6 directly engages with the capsule wall 2 in the area of the shoulder 23. The convex side of the convex membrane 6 is directed upwards. The lower convex surface of the convex membrane has a coupling attachment 8 formed onto it. In FIG. 1 the screw closure with capsule is illustrated without a piercing member 7. The screw closure with capsule marked 1 as a whole, may be produced in a plastic mould, wherein a very simple injection mould is used here.

In the drawing the plastic closure according to the invention is depicted merely as a screw closure. This is, albeit, a preferred embodiment because always realisable, but it is by no means the only possible solution. Thus, for example, the shell wall 25, instead of being provided with an internal thread, may be equipped with a circumferential continuous bead or a bead split up in the partial area, which may be pressed on a container neck with a counteracting bead.

A further possibility would be to design the plastic closure as a hinge closure. In this case the ring-shaped covering surface 24 and the shell wall 25 would be arranged to join at the level of a shoulder 23. A lid is then formed onto the shell wall 25 via a hinge, and the capsule wall 2 with the convex membrane 6 and the coupling attachment 8 with the fitted piercing member 7 are then arranged in the lid. In other words, in the version according to FIG. 3, instead of the guarantee band, a closure lower part would be moulded on, which with the closure part with capsule, is implemented as a lid. The convex membrane 6 then also forms the covering surface of the lid. For protection a protective film may be fitted above the convex membrane, as with the previously described version.

The coupling attachment 8 as shown may be formed as a simple tube portion, and the piercing member placed on top or inserted into it is held thereon in a form-locked or positively locking manner. Should it be desirable for the coupling attachment 8 to be closed at the bottom, the convex membrane may be open without problems above the point where the piercing member is attached, enabling a plug of the injection mould to protrude into it. This plastic closure, here as a screw closure without piercing member, now forms a standard. This standard also, allows plastic closures with capsules to be produced in a very simple way and at low cost by means of corresponding inserts in the injection mould, where the capsule walls 2 may be of varying length. Whilst in FIGS. 1 and 2 a variant is depicted in which the capsule wall protrudes from the screw closure part 20 itself, FIG. 3 shows a variant in which the capsule wall 2 is situated completely within the area of the shell wall 25 of the screw closure. Designs of this kind, which are particularly suitable for screw closures with capsules in which small volumes of the active ingredient are to be stored, can be fitted to containers in conventional filling plants.

In both variants, i.e. variants with high or low capsule wall 2, the chamber 3 may be filled with liquid, granulated or solid active ingredients. Since in most cases there is no problem in increasing the concentration of the active ingredient, it becomes ever more probable for screw closures with very small chambers 3 to be used. Such small chambers have the big advantage that they enable such closures to be fitted on conventional automatic screw closure machines. With screw closures where the capsule wall protrudes at the bottom, special devices must be provided in order to place these closures onto the respective containers.

It should be briefly pointed out that for simplicity's sake the containers mentioned here may be both plastic bottles and glass bottles, but of course, also soft packs provided with an opening for pouring and comprising a flange with a spout provided with an external thread for fitting the plastic closure.

Figure 3:
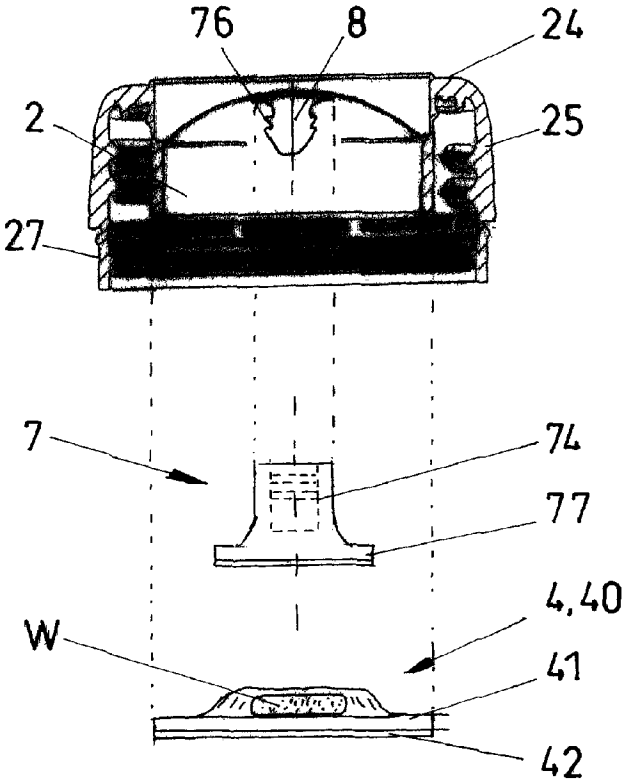
FIG. 3 shows an explosive view of a second variant of a plastic closure according to the invention.

After a piercing member 7 has been placed onto the coupling attachment 8, as shown in FIG. 2, the chamber 3 may be filled with the respective active ingredient and then the sealing film 4 may be welded or glued onto the lower rim of the capsule wall. In particular this type of gluing may be performed using a so-called peeling lacquer. The sealing film is then not destroyed but preferably pushed away except for a small rest by the piercing member.

Thanks to this design according to the invention, in which a coupling attachment is formed onto the convex membrane 6 and a piercing member 7 can be placed onto this coupling attachment, standard closures can be produced, which may be equipped according to customer requirements with an application-specific piercing member. The type of piercing member depends, for example, on what kind of sealing or destructible film 4 is chosen. In FIG. 2 this piercing member 7 consists of a cylindrical guiding wall 71, which is cut inclined to the cylinder axis, wherein an inclined cutting edge is formed which at its deepest point comprises a perforating tooth 73. Centrically to the cylindrical guiding wall 71 a cup-shaped coupling attachment receptacle 74 is held as one piece with the guiding wall 71 via holding arms 75. In the example shown here the coupling attachment receptacle 74 comprises a bottom, which closes the coupling attachment 8 shown here as being open.

In the explosive view of FIG. 3 an identical screw closure with capsule 1 is depicted, wherein the capsule wall 2, as already mentioned, is substantially shortened. A further difference lies in the coupling attachment 8, which is designed here in the shape of a fir cone. In other respects identical parts are marked with identical reference symbols. The piercing member 7 here is configured completely differently. It is substantially smaller in diameter than the piercing member 7 in FIG. 2, and thanks to its shortness this does not need a cylindrical guiding wall 71. The piercing member 7 also has a coupling attachment receptacle 74 which is provided with a blind hole, which has retaining ribs 76 formed into it, as shown by chain-dotted lines. On its side facing the destructible film 4, the piercing member 7 comprises a pressure plate 77. The destructible film 4 is shaped here as a blister 40. This blister 40 as usual comprises a deep-drawn plastic layer 41, and an aluminium film 42 is fitted on the side to be pressed out. The active ingredient W is contained in the blister 40 in tablet form. When the convex membrane 6 is pressed in downward direction, the pressure plate 77 presses upon the elevation of the blister 40 and thereby presses the tablet with the active ingredient W right through the aluminium film 42. This blister pack is in the shape of a round disc and it is welded or glued together with the plastic film layer 41 to the lower rim of the capsule wall 2. This kind of solution has the great advantage that large quantities of such plastic closures with integrated capsule, the chamber of which contains the blister, can be produced with an extremely long shelf life and delivered in this form to the filling companies for them to fit the respective closures on conventional assembly lines within the filling station.

Figure 4:
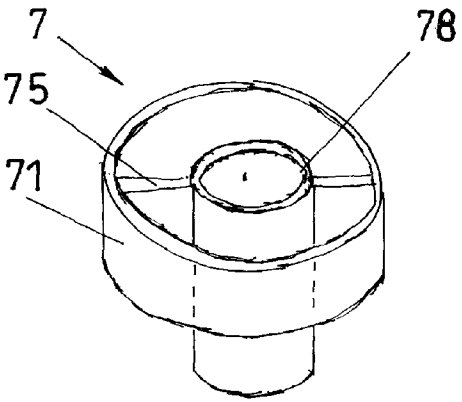
FIG. 4 shows a sketch of a piercing member on its own.
Figure 5:
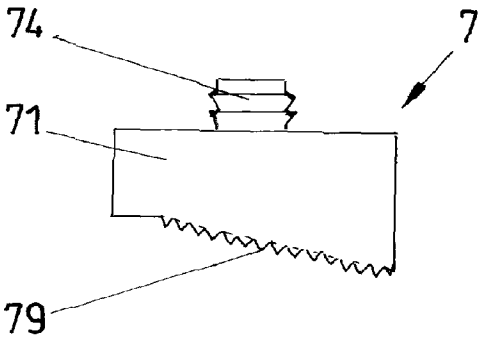
FIG. 5 likewise shows a piercing member but for a destructible film from paper or plastic.

The possibilities of configuring the piercing member 7 are practically limitless. In FIGS. 4 and 5 a solution is shown with a cylindrical guiding wall 71, where the pressing element 78 as such is centrically held via holding arms 75. The guiding wall 71 does not have a proper piercing function in this case and is merely used for guidance. FIG. 5, similar to the solution shown in FIG. 2, again shows a solution, where the cylindrical guiding wall 71 also performs guiding functions. The guiding wall 71 is implemented with cutting and perforating teeth 79. These cutting and perforating teeth 79 are suited, in particular, for plastic films. Since these teeth are not provided all the way round, it is ensured that even if the convex membrane 6 is pushed completely in, the destructible film 4 is not completely separated and thus does not drop into the liquid of the container, to which the screw closure with capsule is fitted. With this variant the coupling attachment receptacle 74 is provided with holding ribs, in order to achieve an increased holding force.

Although in the embodiment shown here the piercing member 7 is connected with the convex membrane 6 via the coupling attachment 8 or the coupling attachment receptacle 74 when assembled, it is also certainly possible to arrange the piercing member 7 in the chamber 3 so as to be only axially movable. In this case it would make sense if the piercing member 7 is equipped with a cylindrical guiding wall 71 and held inside it with a certain degree of friction. Prior to being operated for the first time, the piercing member 7 is retained right up to the top within the capsule wall 2, and by operating the membrane the membrane presses upon the piercing member not bodily connected with it, pushing the same in a downward direction. Such a solution is of some importance insofar as a variant is thereby produced which after its first operation cannot be manipulated. With this variant therefore, the lower face of the flexible membrane 6 can be brought into contact with the replaceable piercing member 7, not necessarily physically, but merely through the way in which it operates. In principle the lower face of the flexible membrane 6 forms so-to-speak a pressure surface which has a coupling attachment function, and the piercing member thus has an interactive pressure surface which acts as a coupling attachment receptacle. Instead of being connected in a positively-locking and/or a force-locked manner, as already mentioned, the two parts are operatively connected only during operation. The concept of offering a solution for different versions sealing film or destructible film is maintained. The term "destructible" is not be understood as only a solution where the film itself is torn or cut, but also where the connection of the film with the capsule wall is achieved and thus the opening of the chamber 3. This can be effected, for example, in that the destructible film is held on the capsule wall 2 by means of a peeling lacquer, thereby, due to the pressure of the piercing member, interrupting the connection between this destructible film and the capsule wall 2. The content of the chamber 3 can thus get into the container, onto which the plastic closure has been placed.

A further variant consists in that also with variants, where a tablet is stored in a blister pack, the pressure plate, for example, can be additionally provided with perforating teeth or cutting teeth. It is, of course, possible to provide only one perforating tooth or one cutting tooth.

LIST OF REFERENCE SYMBOLS

1 plastic closure with capsule/screw closure
2 capsule wall
3 chamber
4 sealing film
5 upper end area
6 convex membrane
7 piercing member
8 coupling part
10 capsule part
20 screw closure part
21 internal thread
22 inner annular wall
23 shoulder
24 horizontal ring-shaped covering surface
25 shell wall
26 predetermined breaking point bridges
27 guarantee band
28 retaining beads
40 coupling attachment

41 plastic film layer
42 aluminium film layer
W active ingredient
71 cylindrical guiding wall
72 end edge inclined
73 perforating tooth
74 cup-shaped coupling attachment receptacle
75 holding arm
76 retaining ribs
77 pressure plate
78 pressure element
79 cutting and perforating teeth

The invention claimed is:

1. A plastic closure comprising:

(a) an integrated capsule for dispensing solid, granulated or liquid active ingredients, wherein the integrated capsule comprises:

(i) a cylindrical or conical pressure-resistant capsule wall with a chamber closable at its lower end by means of a sealing film;

(ii) a convex, flexible membrane formed on an upper end of the capsule wall in one piece therewith;

(iii) a coupling attachment formed as a tube portion centrally on a lower face of the convex flexible membrane; and (iv) a replaceable piercing member comprising a coupling attachment receptacle that removably engages the coupling attachment whereby the replaceable piercing member can be removed from the coupling attachment and thereby from the convex flexible membrane; and (b) a shell wall comprising, a fastening member which is connected to the capsule wall via a ring-shaped covering surface, wherein the shell wall concentrically encircles the capsule wall, and wherein the replaceable piercing member, prior to operation of the convex flexible membrane, rests completely inside the chamber.

2. The plastic closure according to claim 1, wherein the coupling attachment receptacle is cup-shaped and the replaceable piercing member comprises a cylindrical guiding wall, which is held via holding arms so as to concentrically encircle the cup-shaped coupling attachment receptacle.

3. The plastic closure according to claim 2, wherein the guiding wail, on the side that faces the sealing film, is cut inclined towards the centre axis and comprises a cutting edge.

4. The plastic closure according to claim 3, wherein a point of the cutting edge which comes to lie nearest to the sealing film is provided with a perforating tooth.

5. The plastic closure according to claim 1, wherein the plastic closure is configured as a hinge closure, the capsule wall is housed in a cap of the plastic closure and the convex membrane forms a covering surface of the cap.

* * * * *